US007712150B2

(12) United States Patent
Pardillo et al.

(10) Patent No.: US 7,712,150 B2
(45) Date of Patent: May 11, 2010

(54) PROTECTIVE PAD ASSEMBLY MAGNETICALLY ATTACHABLE TO GARMENT

(76) Inventors: Joseph M. Pardillo, 6501 Hammersmith Dr., Raleigh, NC (US) 27613; John Picone, 2488 Arthur Ct., Oceanside, NY (US) 11572

( * ) Notice: Subject to any disclaimer, the term of this patent is extended or adjusted under 35 U.S.C. 154(b) by 66 days.

(21) Appl. No.: 11/865,159

(22) Filed: Oct. 1, 2007

(65) Prior Publication Data

US 2009/0083901 A1 Apr. 2, 2009

(51) Int. Cl.
*A41D 13/00* (2006.01)

(52) U.S. Cl. ..... 2/23; 2/16

(58) Field of Classification Search ..... 2/249, 2/247, 251, 250, 22, 16, 23, 24; 40/586, 40/600, 621, 124.04, 661.01, 426, 1.5, 1.6
See application file for complete search history.

(56) References Cited

U.S. PATENT DOCUMENTS

| | | | | | |
|---|---|---|---|---|---|
| 2,561,872 | A | | 7/1951 | Krinick | |
| 2,568,083 | A | | 9/1951 | Mitchell | |
| 4,561,123 | A | | 12/1985 | Hull | |
| 4,587,956 | A | * | 5/1986 | Griffin et al. | 600/15 |
| 4,748,975 | A | | 6/1988 | Yashima | |
| 5,369,899 | A | * | 12/1994 | Reeves | 40/1.5 |
| 5,732,412 | A | | 3/1998 | Holden | |
| 5,782,743 | A | * | 7/1998 | Russell | 600/9 |
| 5,785,698 | A | | 7/1998 | Van Iten | |
| 5,950,239 | A | * | 9/1999 | Lopez | 2/115 |
| 6,006,363 | A | * | 12/1999 | Karlin | 2/228 |
| 6,014,771 | A | | 1/2000 | Kirven | |
| 6,035,449 | A | | 3/2000 | Galler et al. | |
| 6,146,324 | A | * | 11/2000 | Engel | 600/15 |
| 6,175,963 | B1 | | 1/2001 | Loeffelholz | |
| 6,347,403 | B1 | | 2/2002 | Wilcox | |
| 6,709,729 | B2 | | 3/2004 | Baruch | |
| 6,883,177 | B1 | | 4/2005 | Ouellette et al. | |
| 6,988,281 | B1 | | 1/2006 | Jerome et al. | |
| 7,051,374 | B1 | | 5/2006 | Grilliot et al. | |
| 7,152,246 | B2 | | 12/2006 | Infante | |
| 7,219,372 | B2 | | 5/2007 | Frieler et al. | |
| 2003/0163862 | A1 | | 9/2003 | Hoffman | |
| 2006/0032026 | A1 | | 2/2006 | Schoening et al. | |
| 2007/0028367 | A1 | | 2/2007 | Allen | |

FOREIGN PATENT DOCUMENTS

| | | |
|---|---|---|
| EP | 1 000 563 | 5/2000 |
| KR | 2007 0111265 | 11/2007 |
| WO | WO 99/42011 | 8/1999 |

* cited by examiner

*Primary Examiner*—Tejash Patel
(74) *Attorney, Agent, or Firm*—Berenato & White, LLC

(57) ABSTRACT

A protective pad assembly for releasably attaching to a garment, comprises a flexible inner member provided to be disposed inside the garment, an outer member provided to be disposed outside the garment and a securing device provided for releasably attaching the outer member to the inner member. The outer member further includes an outer protective pad. The securing device includes an inner magnetically attractive element attached to the inner member and an outer magnetically attractive element attached to the outer member. The outer magnetically attractive element and the inner magnetically attractive element are magnetically attractable to each other so as to hold the protective pad assembly in place on the garment. Moreover, one of the inner magnetically attractive element and the outer magnetically attractive element is a magnet.

22 Claims, 9 Drawing Sheets

PRIOR ART

PROTECTIVE PAD ASSEMBLY MAGNETICALLY ATTACHABLE TO GARMENT

BACKGROUND OF THE INVENTION

1. Field of the Invention

The present invention relates to fastening of protective cushioning devices in general, and more particularly to a protective pad magnetically attachable directly to a garment for protecting user's knee and/or elbow joints.

2. Description of the Prior Art

Typically, protective pad, or cushioning, devices, such as knee pads, are attached to a body part of a user by various methods including belt straps, clips, wraps, elastic stretching, glues, tapes and adhesives. The common drawback of prior art methods of fastening is that they become uncomfortable to the user (wearer) during prolonged usage do to binding, burning and chaffing which results in irritation to the skin and limb tingling and bruising which is brought on by constricting of the blood vessels. FIG. 1 shows a common kneepad 1 fastened to the user's leg 6 utilizing straps 3*a* and 3*b* to attach the kneepad 1 to a knee area 7 of the leg 6. A strap 3*a* wraps around the back of the lower thigh portion 6*a*, and whereas a strap 3*b* wraps around the upper calf portion 6*b*. The straps 3*a* and 3*b* cause constriction of the blood vessels and eventually cut and chafe the thigh portion 6*a* and the calf portion 6*b*, respectively.

Therefore, there is a need for a protective pad assembly that overcomes shortcomings of the prior art and advances the art.

SUMMARY OF THE INVENTION

The present invention is a protective pad assembly for releasably attaching to a garment in order to protect user's body joints, such as knee and/or elbow joints.

The protective pad assembly of the present invention comprises a flexible inner member provided to be disposed inside the garment, an outer member provided to be disposed outside the garment and a securing device provided for releasably attaching the outer member to the inner member. The outer member further includes an outer protective pad. The securing device includes an inner magnetically attractive element attached to the inner member and an outer magnetically attractive element attached to the outer member. The outer magnetically attractive element and the inner magnetically attractive element are magnetically attractable to each other so as to hold the protective pad assembly in place on the garment. Moreover, one of the inner magnetically attractive element and the outer magnetically attractive element is a magnet.

The protective pad assembly in accordance with the present invention makes the wearing of protective pad assembly more comfortable and eliminates the risk of blood clots and nerve damage due to the strangulation effect of straps tightly pulled around user's limb.

BRIEF DESCRIPTION OF THE DRAWINGS

The objects and advantages of the invention will become apparent from a study of the following specification when viewed in light of the accompanying drawings, wherein.

DETAILED DESCRIPTION OF PREFERRED EMBODIMENTS

Figure 2:
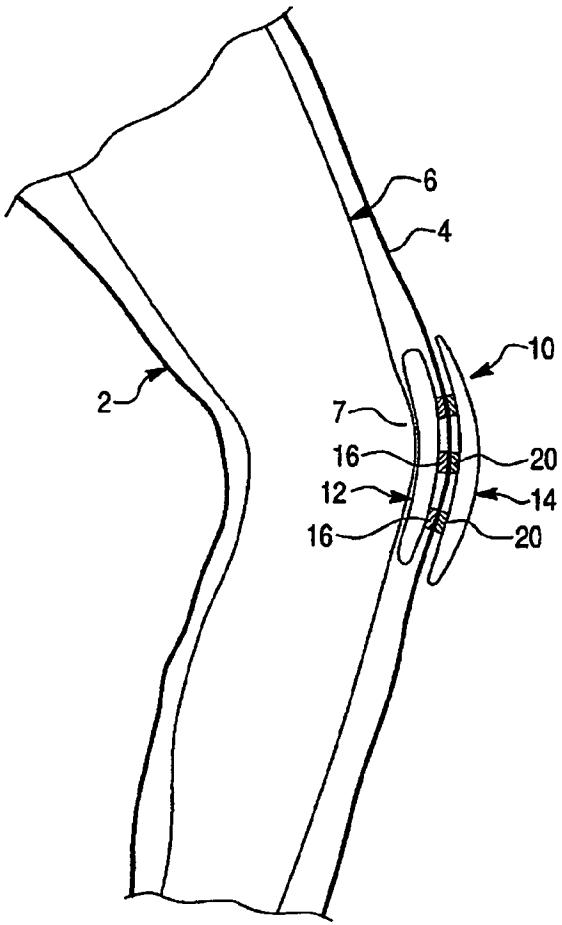
FIG. 2 is a sectional view of a knee pad assembly in accordance with a first exemplary embodiment of the present invention.
Figure 1:
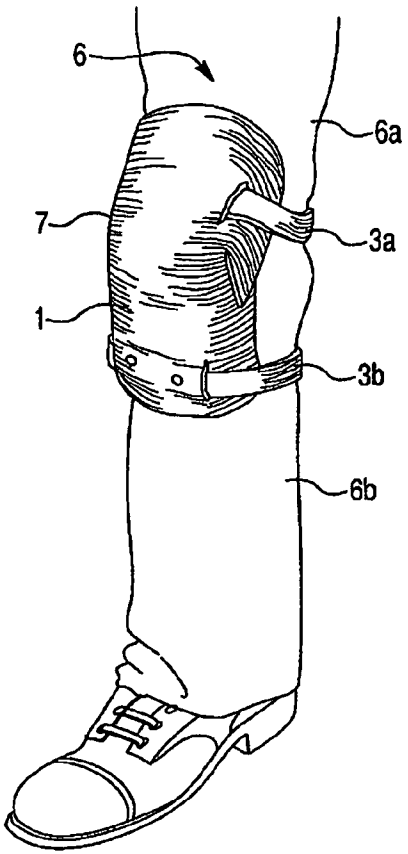
FIG. 1 is a perspective view showing a kneepad of the prior art.

The preferred embodiment of the present invention will now be described with the reference to accompanying drawings. For purposes of the following description, certain terminology is used in the following description for convenience only and is not limiting. The words "inner" and "outer", "bottom" and "top", "inside" and "outside" designate directions in the drawings to which reference is made. However, it is to be understood that the invention may assume various alternative orientations, except where expressly specified to the contrary. The terminology includes the words specifically mentioned above, derivatives thereof and words of similar import.

It is also to be understood that the specific article illustrated in the attached drawings, and described in the following specification is simply exemplary embodiment of the inventive concept. Specific dimensions and other physical characteristics relating to the embodiment disclosed herein are not to be considered as limiting, unless expressly stated otherwise. Additionally, the word "a," as used in the claims, means "at least one."

FIGS. 2 and 3A-4B of the accompanying drawings illustrate a first exemplary embodiment of a protective pad assembly of the present invention in the form of a knee pad assembly 10 for releasably attaching to a garment, such as trousers (pants) 2 shown in FIG. 2. The knee pad assembly 10 of the present invention comprises a flexible inner member (or base cushion made of an impact absorbing material) 12 provided to be disposed inside the pants 2, and an outer member (or protective topical cushion made of an impact absorbing material) 14 provided to be disposed outside the pants 2, as further illustrated in FIG. 2. The knee pad assembly 10 further comprises a securing device provided for releasably attaching the outer member 14 and the inner member 12 to each other Specifically, the securing device includes at least one inner magnetically attractive element 16 attached to the inner member 12, and at least one outer magnetically attractive element 20 attached to the outer member 14. Preferably, as illustrated in FIGS. 2 and 3A-4B, the securing device includes a plurality of the inner and outer magnetically attractive elements 16 and 20, respectively. Moreover, the number and location of the inner magnetically attractive elements 16 is complementary to a number and location of the outer magnetically attractive elements 20. It will be appreciated that the inner magnetically attractive elements 16 and the outer magnetically attractive elements 20 are magnetically attractable to each other.

Figure 3A:
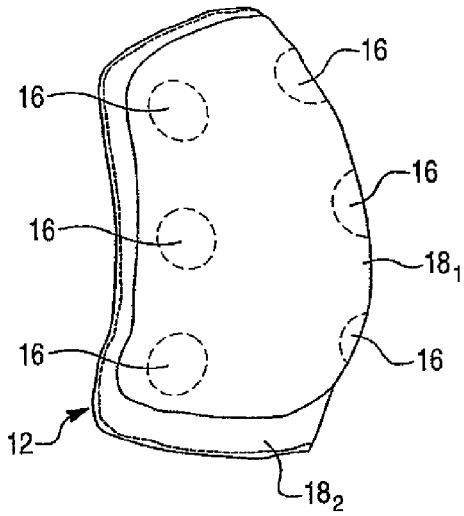
FIG. 3A is a front perspective view of an inner member of the knee pad assembly in accordance with the first exemplary embodiment of the present invention.
Figure 3B:
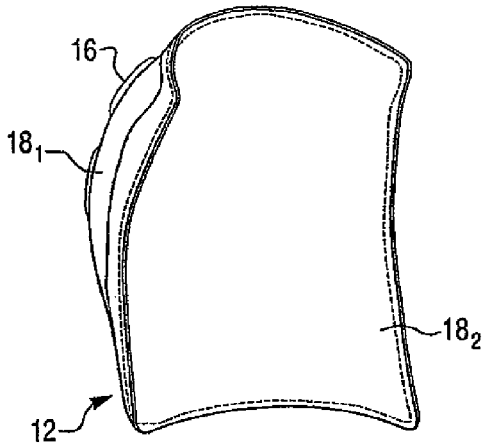
FIG. 3B is a rear perspective view of the inner member of the knee pad assembly in accordance with the first exemplary embodiment of the present invention.

The flexible inner member 12, illustrated in detail in FIGS. 3A and 3B, includes a front layer $\mathbf{18}_1$ and a base layer $\mathbf{18}_2$ attached to each other in any appropriate manner known in the art, such as by sewing the layers $\mathbf{18}_1$ and $\mathbf{18}_2$ to each other. The inner magnetically attractive elements 16, shown in phantom lines in FIG. 3A, are disposed between the front and base layers $\mathbf{18}_1$ and $\mathbf{18}_2$, respectively, of the inner member 12, and are affixed to either front layer $\mathbf{18}_1$ or the base layer $\mathbf{18}_2$ by any appropriate means known in the art, such as by adhesive bonding. The front and base layers $\mathbf{18}_1$ and $\mathbf{18}_2$ of the inner member 12 are made of any appropriate flexible material, such as fabric, soft nylon lining, etc.

Figure 4A:
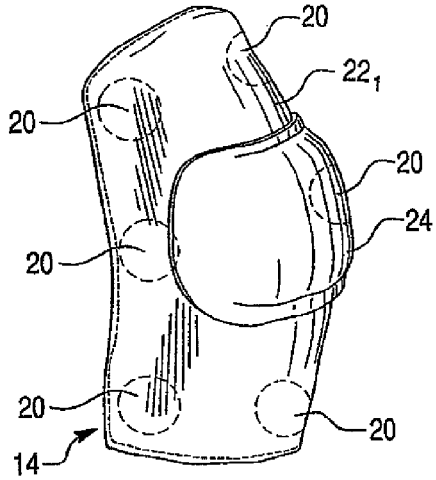
FIG. 4A is a front perspective view of an outer member of the knee pad assembly in accordance with the first exemplary embodiment of the present invention.
Figure 4B:
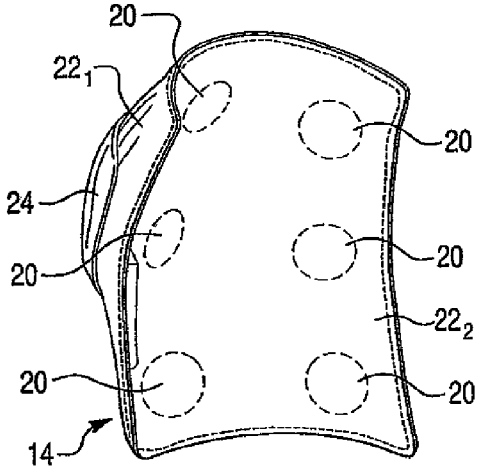
FIG. 4B is a rear perspective view of the outer member of the knee pad assembly in accordance with the first exemplary embodiment of the present invention.

The outer member 14, illustrated in detail in FIGS. 4A and 4B, includes a front layer $\mathbf{22}_1$ and a base layer $\mathbf{22}_2$ attached to each other in any appropriate manner known in the art, such as by sewing the layers $\mathbf{22}_1$ and $\mathbf{22}_2$ to each other. The outer magnetically attractive elements 20, as shown in phantom lines in FIGS. 4A and 4B, are disposed between the front and base layers $\mathbf{22}_1$ and $\mathbf{22}_2$, respectively, of the outer member 14, and are affixed to either front layer $\mathbf{22}_1$ or the base layer $\mathbf{22}_2$ by any appropriate means known in the art, such as by adhesive bonding. The front and base layers $\mathbf{22}_1$ and $\mathbf{22}_2$ of the outer member 14 are made of any appropriate flexible material, such as fabric, soft nylon lining, etc. As further shown in FIGS. 4A and 4B, the outer member 14 also includes an outer protective pad 24 attached to the front layer $\mathbf{22}_1$ of the outer member 14 in any appropriate manner known in the art, such as by adhesively bonding or sewing into the front layer $\mathbf{22}_1$.

According to the present invention, at least one of the inner magnetically attractive elements 16 and the outer magnetically attractive elements 20 are in the form of magnet. Preferably, both the inner magnetically attractive elements 16 and the outer magnetically attractive elements 20 are in the form of magnet, such as permanent magnets. Alternatively, only the inner magnetically attractive elements 16 or the outer magnetically attractive elements 20 are in the form of magnets. In this case, the opposite magnetically attractive elements are in the form of elements made of a ferromagnetic material, such as steel. Preferably, as illustrated in FIGS. 3A-4B, the inner and outer magnetically attractive elements 16 and 20 are substantially thin, cylindrical pieces of magnet or ferromagnetic material.

In operation, as illustrated in FIG. 2, on a clothed individual (user), the inner member 12 is placed inside the garment (or undergarment) 2 in the area of the body that needs protection, such as a knee 7 shown in FIG. 2, and whereas the outer member 14 is placed on the outside of the garment 2 directly over the inner member 12. It will be appreciated that the location of the inner magnetically attractive elements 16 on the inner member 12 minors (is complementary to) the location of the outer magnetically attractive elements 20 on the outer member 14. Accordingly, magnetic attraction between the inner magnetically attractive elements 16 of the inner member 12 and the outer magnetically attractive elements 20 of the outer member 14 holds the knee pad assembly 10 in place on the garment 2. With the arrangement of the magnetic securing device of the present invention, the user can easily disengage the outer member 14 from the garment 2, and reattach the outer member 14. As further illustrated in FIG. 2, the outer member 14 is releasably attached to the inner member 12 solely by the magnetic attraction force between the outer magnetically attractive elements 20 and the inner magnetically attractive elements 16.

More specifically, when the knee 7 of the user is flexed, the knee pad assembly 10 will stay with the pant 2 and give full coverage. When the user is in a standing position, the knee pad assembly 10 will hang on the pant leg 4, away from the user's leg 6, and allow airflow. The present invention allows the user to comfortably wear the knee pad assembly 10 and eliminates the risk of blood clots and nerve damage due to the strangulation effect of straps of the conventional kneepads tightly pulled around user's leg 6. When the job is done the knee pad assembly 10 is easily disengaged and the knee pad assembly can be used the same way on another pair of pants.

FIGS. 5 and 6A-7B illustrate a second exemplary embodiment of a protective pad assembly of the present invention in the form of a knee pad assembly for releasably attaching to a garment, such as trousers (pants) 2, generally depicted by the reference character 110. Components, which are unchanged from the previous exemplary embodiments of the present invention, are labeled with the same reference characters. Components, which function in the same way as in the first exemplary embodiment of the present invention depicted in FIGS. 2 and 3A-4B are designated by the same reference numerals to which 100 has been added, sometimes without being described in detail since similarities between the corresponding parts in the two embodiments will be readily perceived by the reader.

Figure 5:
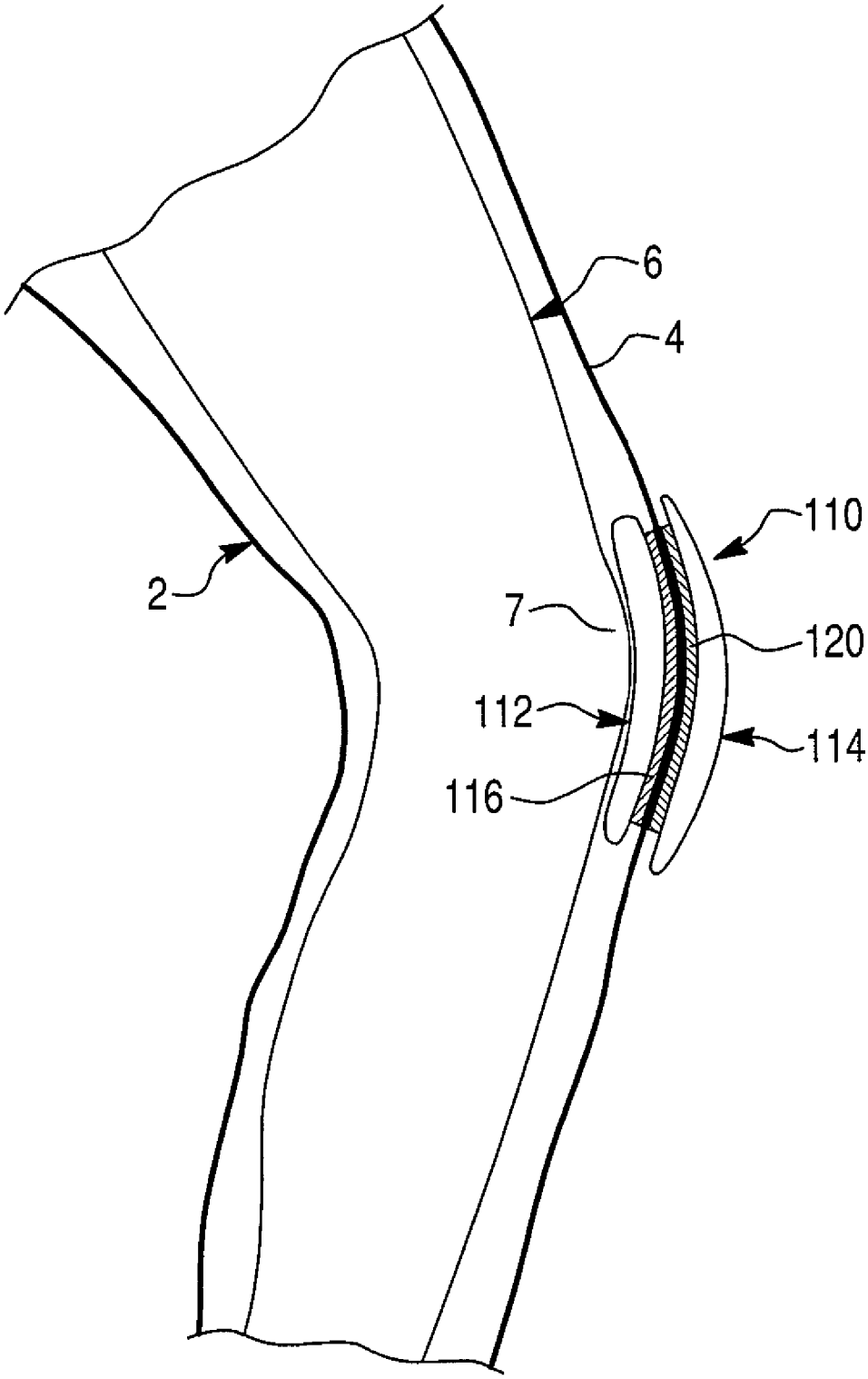
FIG. 5 is a sectional view of a knee pad assembly in accordance with a second exemplary embodiment of the present invention.

The knee pad assembly 110 in accordance with the second exemplary embodiment of the present invention comprises a flexible inner member (or base cushion made of an impact absorbing material) 112 provided to be disposed inside the pants 2, and an outer member (or protective topical cushion made of an impact absorbing material) 114 provided to be disposed outside the pants 2, as further illustrated in FIG. 5. The knee pad assembly 110 further comprises a securing device provided for releasably attaching the outer member 114 and the inner member 112 to each other. Specifically, the securing device according to the second exemplary embodiment of the present invention includes a single inner magnetically attractive element 116 attached to the inner member 112, and a single outer magnetically attractive element 120 attached to the outer member 114. Preferably, as illustrated in FIGS. 5 and 6A-7B, each of the inner and outer magnetically attractive elements 116 and 120, respectively, is in the form of a flexible sheet of magnet (a full surface magnet). Moreover, a location of the inner magnetically attractive element 116 is complementary to a location of the outer magnetically attractive element 120. It will be appreciated that the inner magnetically attractive element 116 and the outer magnetically attractive element 120 are magnetically attractable to each other. Preferably, each of the sheets of magnet 116 and 120 has an area slightly smaller than areas of the inner member 112 and the outer member 114, respectively. In other words, each of the sheets of magnet 116 and 120 has the area substantially equal to the area of the inner member 112 and the outer member 114, respectively.

It will be appreciated that magnetic attraction between the inner member 112 and the outer member 114 will hold the knee pad assembly 110 in place on the garment 2. Alternatively, instead of having two sheets of magnet 116 and 120, a sheet of ferromagnetic material can be used to replace or substitute one of the full surface sheet of magnet for either the inner member 112 or the outer member 114 to facilitate magnetic attraction. Such an arrangement would cut costs considerably and use less of the expensive magnetic material during manufacturing. As further illustrated in FIG 5, the outer member 114 is releasably attached to the inner member 112 solely by the magnetic attraction force between the outer magnetically attractive elements 120 and the inner magnetically attractive elements 116.

Figure 6A:
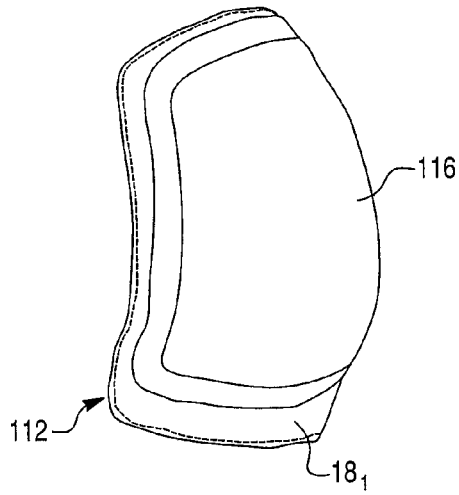
FIG. 6A is a front perspective view of an inner member of the knee pad assembly in accordance with the second exemplary embodiment of the present invention.
Figure 6B:
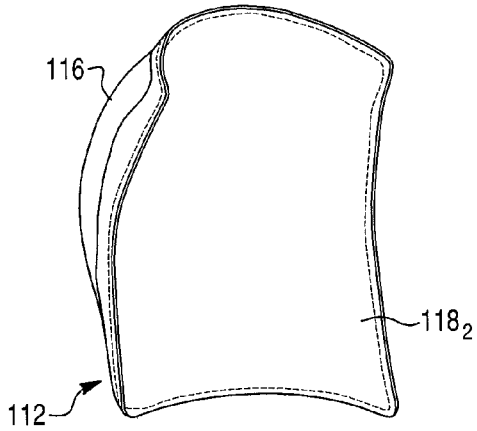
FIG. 6B is a rear perspective view of the inner member of the knee pad assembly in accordance with the second exemplary embodiment of the present invention.

The flexible inner member 112, illustrated in detail in FIGS. 6A and 6B, includes a front layer $\mathbf{118}_1$ and a base layer $\mathbf{118}_2$ (such as a soft nylon lining) attached to each other in any appropriate manner known in the art, such as by sewing the layers $\mathbf{118}_1$ and $\mathbf{118}_2$ to each other. Preferably, the inner sheet of magnet 116 is affixed to the front layer $\mathbf{118}_1$ of the inner member 112 by any appropriate means known in the art, such as by adhesive bonding. Alternatively, the inner sheet of magnet 116 may be disposed between the front and base layers $\mathbf{118}_1$ and $\mathbf{118}_2$, respectively, of the inner member 112, and affixed to either front layer $\mathbf{118}_1$ or the base layer $\mathbf{118}_2$ by any appropriate means known in the art, such as by adhesive bonding. The front and base layers $\mathbf{118}_1$ and $\mathbf{118}_2$ of the inner member 112 are made of any appropriate flexible material, such as fabric, soft nylon lining, etc.

Figure 7A:
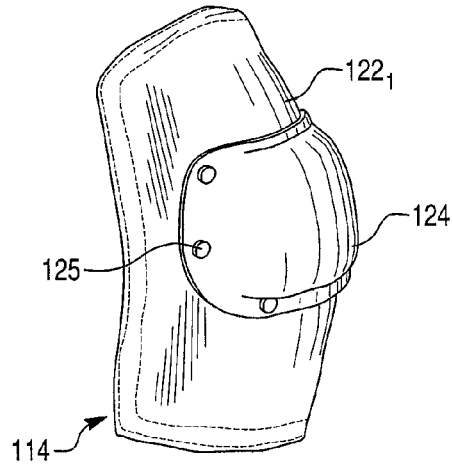
FIG. 7A is a front perspective view of an outer member of the knee pad assembly in accordance with the second exemplary embodiment of the present invention.
Figure 7B:
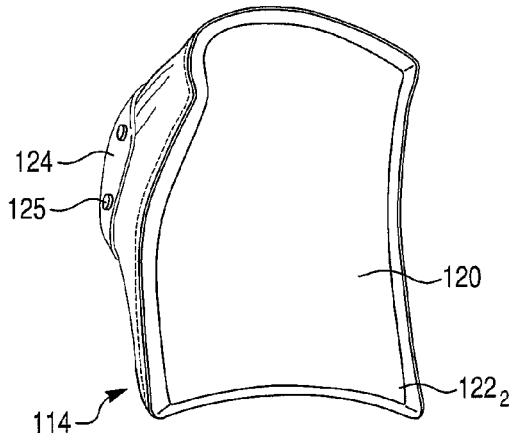
FIG. 7B is a rear perspective view of the outer member of the knee pad assembly in accordance with the second exemplary embodiment of the present invention.

The outer member 114, illustrated in detail in FIGS. 7A and 7B, includes a front layer $\mathbf{122}_1$ and a base layer $\mathbf{122}_2$ attached to each other in any appropriate manner known in the art, such as by sewing the layers $\mathbf{122}_1$ and $\mathbf{122}_2$ to each other. Preferably, the outer sheet of magnet 120 is affixed to the front layer $\mathbf{122}_1$ of the outer member 114 by any appropriate means known in the art, such as by adhesive bonding. Alternatively, the outer sheet of magnet 120 may be disposed between the front and base layers $\mathbf{122}_1$ and $\mathbf{122}_2$, respectively, of the outer member 114, and affixed to either front layer $\mathbf{122}_1$ or the base layer $\mathbf{122}_2$ by any appropriate means known in the art, such as by adhesive bonding. The front and base layers $\mathbf{122}_1$ and $\mathbf{122}_2$ of the outer member 114 are made of any appropriate flexible material, such as fabric, soft nylon lining, etc. As further shown in FIGS. 7A and 7B, the outer member 114 also includes an outer protective pad 124 attached to the front layer $\mathbf{122}_1$ of the outer member 114 in any appropriate manner known in the art, such as by adhesively bonding or sewing into the front layer $\mathbf{122}_1$. Preferably, the outer protective pad 124 attached with rivets 125 to the front layer $\mathbf{122}_1$ of the outer member 114.

The operation of the knee pad assembly 110 according to the second exemplary embodiment of the present invention is substantially similar to the knee pad assembly 10 according to the first exemplary embodiment.

FIGS. 8 and 9A-10B illustrate a third exemplary embodiment of a protective pad assembly of the present invention in the form of a knee pad assembly for releasably attaching to a garment, such as trousers (pants) 2, generally depicted by the reference character 210. Components, which are unchanged from the previous exemplary embodiments of the present invention, are labeled with the same reference characters. Components, which function in the same way as in the first exemplary embodiment of the present invention depicted in FIGS. 2 and 3A-4B are designated by the same reference numerals to which 200 has been added, sometimes without being described in detail since similarities between the corresponding parts in the two embodiments will be readily perceived by the reader.

Figure 8:
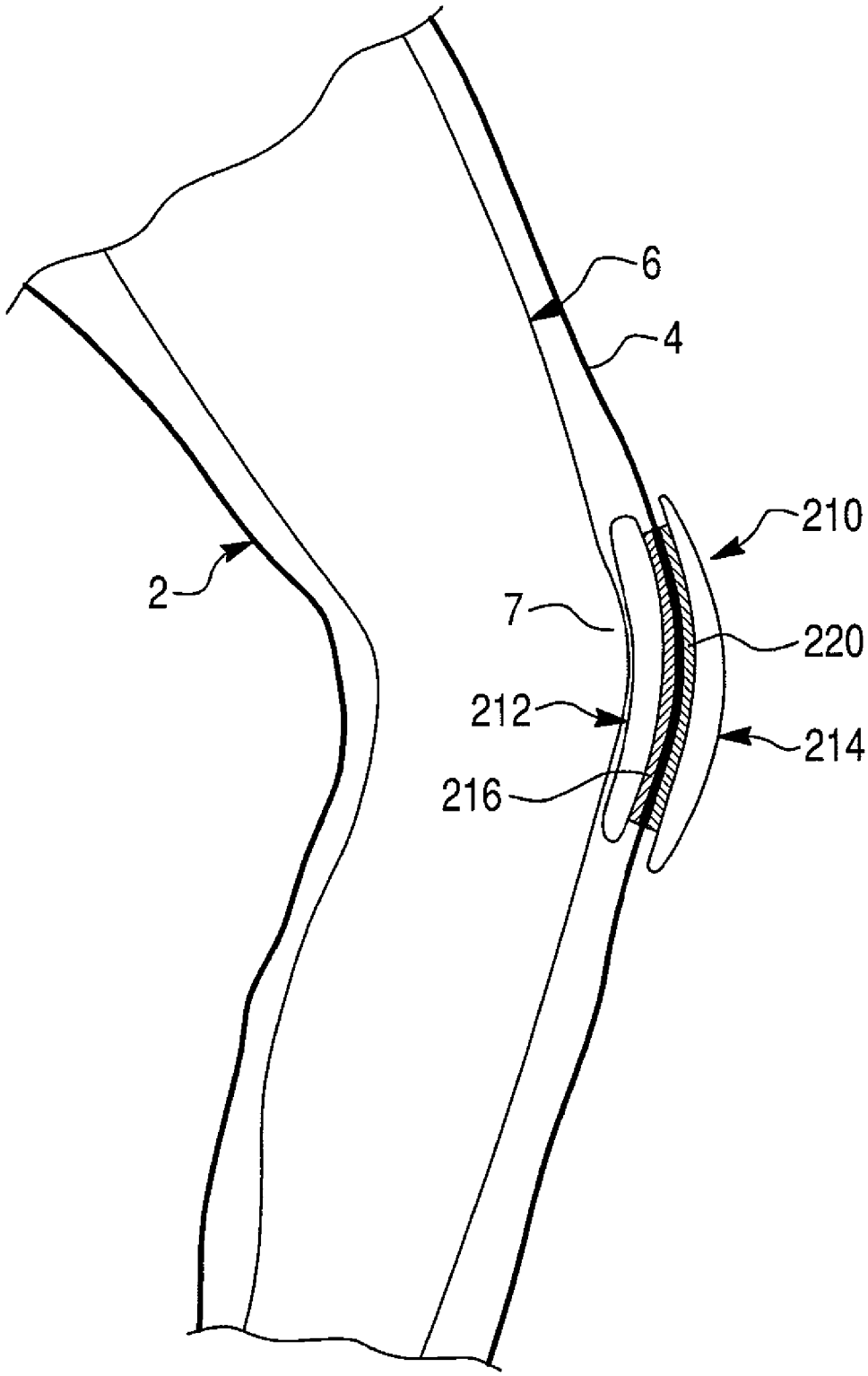
FIG. 8 is a sectional view of a knee pad assembly in accordance with a third exemplary embodiment of the present invention.

The knee pad assembly 210 in accordance with the third exemplary embodiment of the present invention comprises a flexible inner member (or base cushion) 212 provided to be disposed inside the pants 2, and an outer member (or protective topical cushion) 214 provided to be disposed outside the pants 2, as further illustrated in FIG. 8. The knee pad assembly 210 further comprises a securing device provided for releasably attaching the outer member 214 and the inner member 212 to each other. Specifically, the securing device according to the third exemplary embodiment of the present invention includes a single inner magnetically attractive element 216 attached to the inner member 212, and a single outer magnetically attractive element 220 attached to the outer member 214.

Figure 9A:
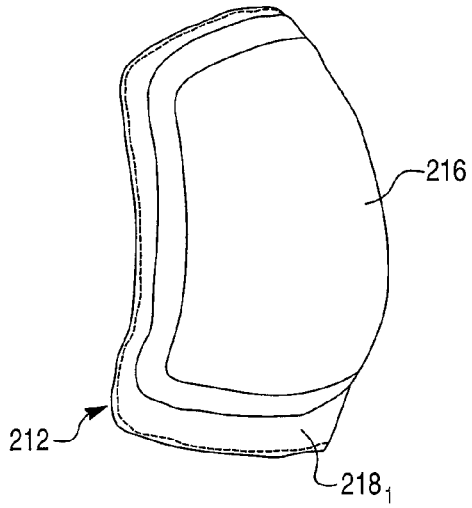
FIG. 9A is a front perspective view of an inner member of the knee pad assembly in accordance with the third exemplary embodiment of the present invention.
Figure 10A:
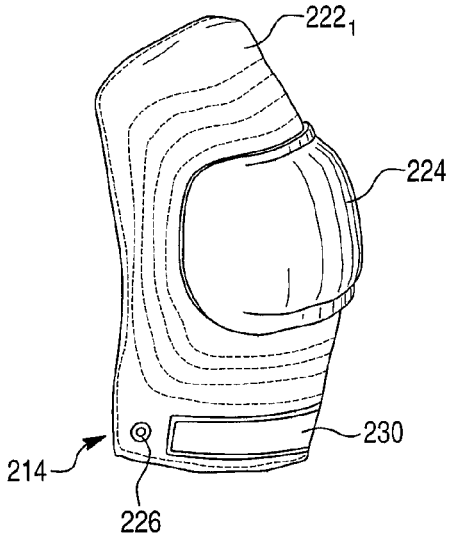
FIG. 10A is a front perspective view of an outer member of the knee pad assembly in accordance with the third exemplary embodiment of the present invention.
Figure 10B:
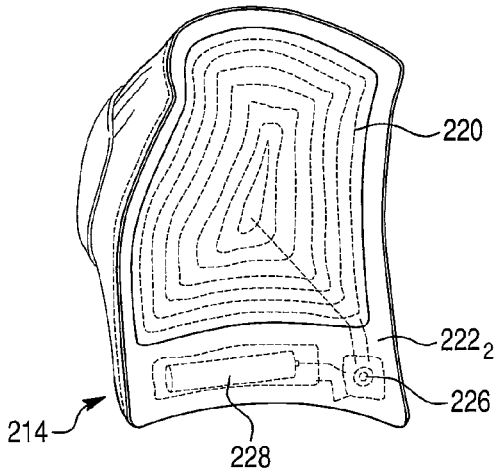
FIG. 10B is a rear perspective view of the outer member of the knee pad assembly in accordance with the third exemplary embodiment of the present invention.

Preferably, the inner magnetically attractive element 216 is in the form of a full surface sheet of ferromagnetic material (as illustrated in FIGS. 8 and 9A), while the outer magnetically attractive element 220 is in the form of an electromagnet, as illustrated in FIGS. 8 and 10A-10B. Moreover, a location of the sheet of ferromagnetic material 216 is complementary to a location of the electromagnet 220. It will be appreciated that the sheet of ferromagnetic material 116 and the electromagnet 120 are magnetically attractable to each other. It will be appreciated that magnetic attraction between the inner member 212 and the outer member 214 will hold the knee pad assembly 210 in place on the garment 2.

Figure 9B:
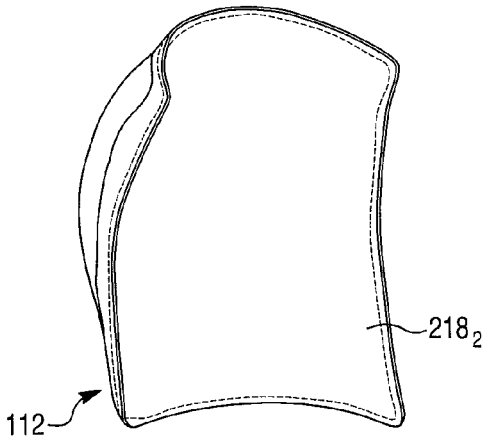
FIG. 9B is a rear perspective view of the inner member of the knee pad assembly in accordance with the third exemplary embodiment of the present invention.

The flexible inner member 212, illustrated in detail in FIGS. 9A and 9B, includes a front layer $\mathbf{218}_1$ and a base layer $\mathbf{218}_2$ (such as a soft nylon lining) attached to each other in any appropriate manner known in the art, such as by sewing the layers $\mathbf{218}_1$ and $\mathbf{218}_2$ to each other. Preferably, the sheet of ferromagnetic material 216 is affixed to an outer surface of the front layer $\mathbf{218}_1$ of the inner member 212 by any appropriate means known in the art, such as by adhesive bonding, while the base layer $218_2$ in the form of a soft nylon lining is attached to an inner surface of the front layer $218_1$. Alternatively, the sheet of ferromagnetic material 116 may be disposed between the front and base layers $218_1$ and $218_2$, respectively, of the inner member 212, and affixed to either front layer $218_1$ or the base layer $218_2$ by any appropriate means known in the art, such as by adhesive bonding. The front and base layers $218_1$ and $218_2$ of the inner member 212 are made of any appropriate flexible material, such as fabric, soft nylon lining, etc.

The outer member 214, illustrated in detail in FIGS. 10A and 10B, includes a front layer $222_1$ and a base layer $222_2$ attached to each other in any appropriate manner known in the art, such as by sewing the layers $222_1$ and $222_2$ to each other. Preferably, the electromagnet 220 is affixed to an outer surface of the base layer $222_2$ of the outer member 214 by any appropriate means known in the art, such as by adhesive bonding. The outer member 214 further includes a switch 226 for selectively actuating the electromagnet 220, and a battery 228 supplying electrical current to the electromagnet 220 disposed in a battery compartment 230. The battery compartment 230 is formed in the outer member 214 so as to allow access to change the battery 228. The switch 226 is accessed and located on a frontal surface of the outer member 214 easily accessible by the user as shown in FIG. 10A. Alternatively, the electromagnet 220 may be disposed between the front and base layers $222_1$ and $222_2$, respectively, of the outer member 214, and affixed to either front layer $222_1$ or the base layer $222_2$ by any appropriate means known in the art, such as by adhesive bonding. The front and base layers $222_1$ and $222_2$ of the outer member 214 are made of any appropriate material known in the art. As further shown in FIGS. 10A and 10B, the outer member 214 also includes an outer protective pad 224 attached to the front layer $222_1$ of the outer member 214 in any appropriate manner known in the art, such as by adhesively bonding or sewing into the front layer $222_1$.

Activation of the electromagnet 220 of the outer member 214 provides the magnetic attraction to engage full surface sheet of ferromagnetic material 216 of the inner member 212 holding the knee pad assembly 210 in place on the garment 2. The operation of the knee pad assembly 210 according to the third exemplary embodiment of the present invention is substantially similar to the knee pad assembly 10 according to the first exemplary embodiment.

Figure 11:
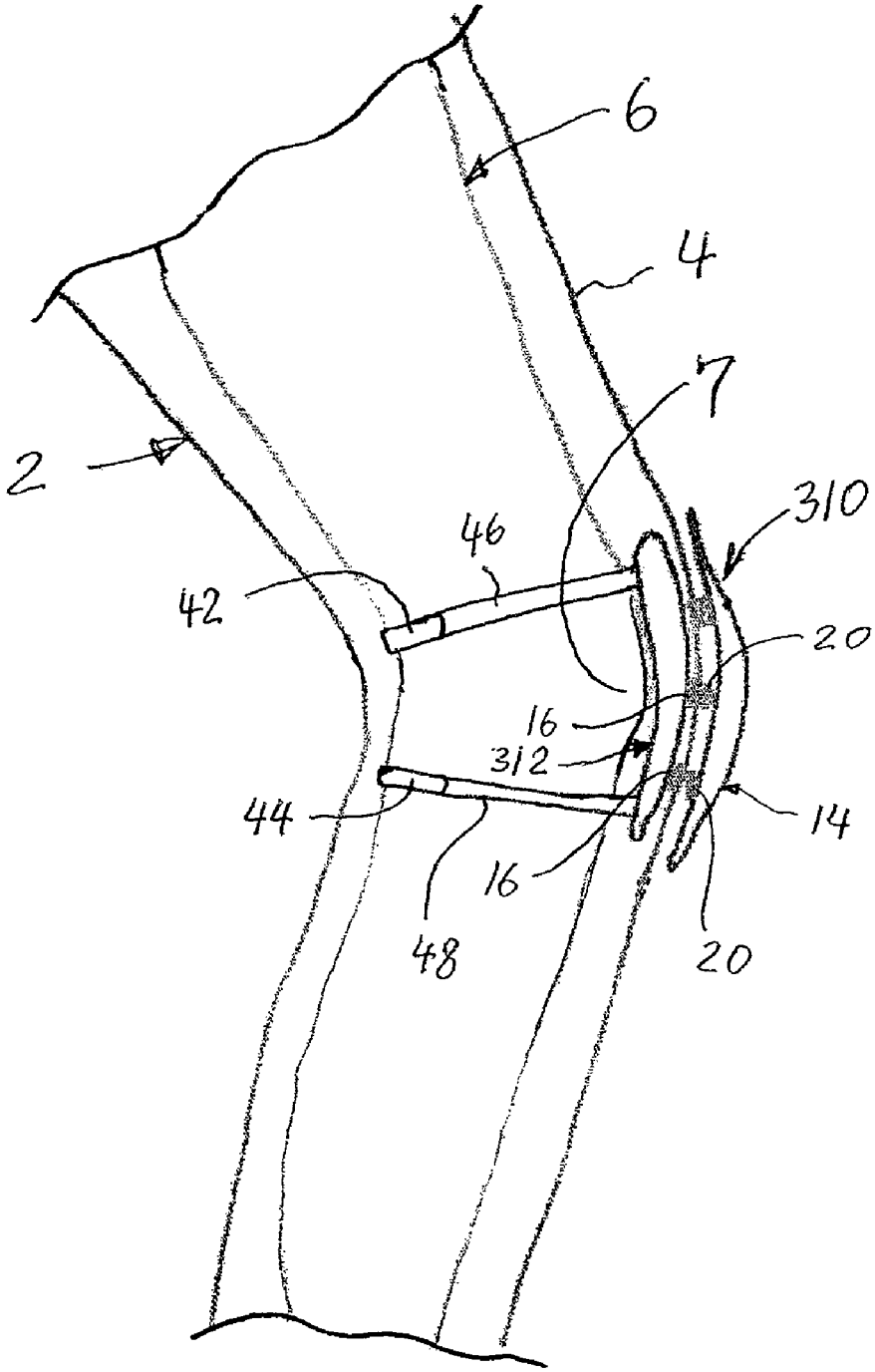
FIG. 11 is a sectional view of a knee pad assembly in accordance with a fourth exemplary embodiment of the present invention.
Figure 12A:
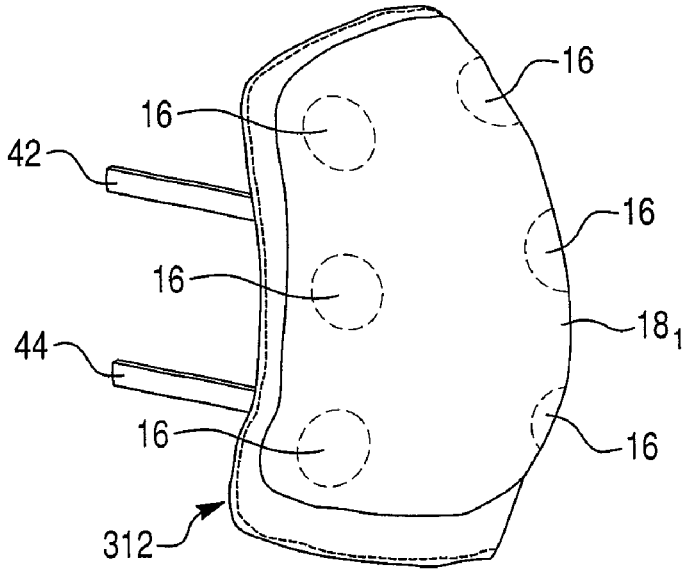
FIG. 12A is a front perspective view of an inner member of the knee pad assembly in accordance with the fourth exemplary embodiment of the present invention.
Figure 12B:
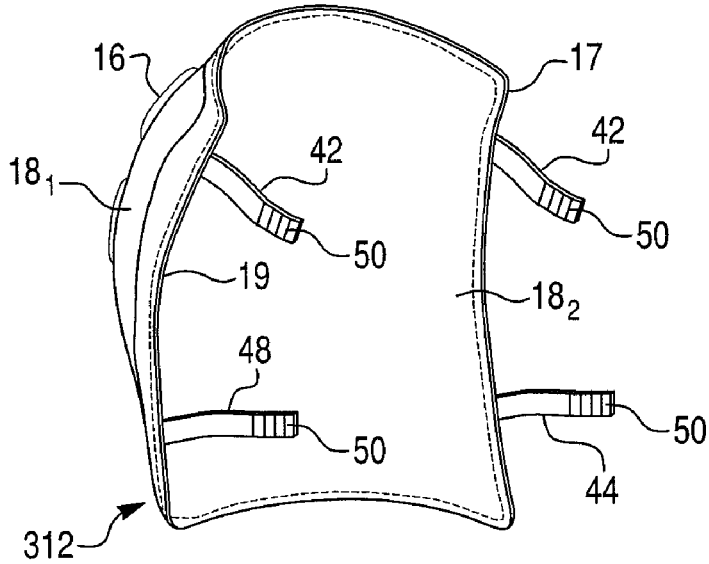
FIG. 12B is a rear perspective view of the inner member of the knee pad assembly in accordance with the fourth exemplary embodiment of the present invention.

FIGS. 11 and 12A-12B illustrate a fourth exemplary embodiment of a protective pad assembly of the present invention in the form of a knee pad assembly for releasably attaching to a garment, such as trousers (pants) 2, generally depicted by the reference character 310. Components, which are unchanged from the previous exemplary embodiments of the present invention, are labeled with the same reference characters. Components, which function in the same way as in the first exemplary embodiment of the present invention depicted in FIGS. 2 and 3A-4B are designated by the same reference numerals to which 300 has been added, sometimes without being described in detail since similarities between the corresponding parts in the two embodiments will be readily perceived by the reader.

The knee pad assembly 310 in accordance with the fourth exemplary embodiment of the present invention comprises a flexible inner member (or base cushion) 312 provided to be disposed inside the pants 2, and an outer member (or protective topical cushion) 14 provided to be disposed outside the pants 2, as further illustrated in FIG. 5. Alternatively, both the inner member 312 and the outer member 14 could be disposed outside the pants 2. The knee pad assembly 310 further comprises a securing device provided for releasably attaching the outer member 14 and the inner member 312 to each other. The knee pad assembly 310 of FIGS. 11 and 12A-12B corresponds substantially to the knee pad assembly 10 of the first exemplary embodiment of the present invention depicted in FIGS. 2 and 3A-4B, and only the inner member 312, which differs, will therefore be explained in detail below.

The flexible inner member 312, illustrated in detail in FIGS. 11 and 12A-12B, includes a front layer $18_1$ and a base layer $18_2$ (such as a soft nylon lining) attached to each other in any appropriate manner known in the art, such as by sewing the layers $18_1$ and $18_2$ to each other. Preferably, the inner magnetically attractive elements 16, shown in phantom lines in FIG. 12A, are disposed between the front and base layers $18_1$ and $18_2$, respectively, of the inner member 312, and are affixed to either front layer $18_1$ or the base layer $18_2$ by any appropriate means known in the art, such as by adhesive bonding. The front and base layers $18_1$ and $18_2$ of the inner member 312 are made of any appropriate flexible material, such as fabric, soft nylon lining, etc.

The flexible inner member 312 further includes two pair of straps: 42 and 44 attached about a periphery of the inner member 312. Specifically, the straps 42 and 44 are attached to a first (right) vertical edge 17 of the inner member 312, while the straps 46 and 48 are attached to a second (left) vertical edge 19 thereof (as shown in FIG. 12B). The straps 42, 44, 46 and 48 constitute means for strapping flexible inner member 312 to the leg 6 of the user. Specifically, the straps 42 and 46 are provided for strapping flexible inner member 312 to the leg 6 of the user above the knee 7, while the straps 44 and 48 are provided for strapping flexible inner member 312 to the leg 6 of the user below the knee 7. Distal ends of the straps 42, 44, 46 and 48 are secured to each other by means of any suitable fastening means known in the art, such as "Velcro"-type fastening means, in which the distal (free) end of each of the straps 42, 44, 46 and 48 has patches 50 of complementary hook and loop fastener elements thereon thereby releasably fastening the straps 42, 44, 46 and 48 in position for strapping the flexible inner member 312 in place on the leg 6. It is to be understood that the particular type of releasable fastening means, such as "Velcro"-type fastening means, clips, snap connectors, etc., is well within the knowledge of one or ordinary skill in the art and therefore will not be elaborated.

FIGS. 13 and 14A-14B and 15 illustrate a fifth exemplary embodiment of a protective pad assembly of the present invention. The protective pad assembly in accordance with the fifth exemplary embodiment of the present invention comprises a flexible inner member provided to be disposed inside the pants, and an outer member 414 provided to be disposed outside the pants. The protective pad assembly in accordance with the fifth exemplary embodiment of the present invention corresponds substantially to the knee pad assembly 10 of the first exemplary embodiment of the present invention depicted in FIGS. 2 and 3A-4B, and only the outer member 414, which differs, will therefore be explained in detail below. Components, which are unchanged from the previous exemplary embodiments of the present invention, are labeled with the same reference characters. Components, which function in the same way as in the first exemplary embodiment of the present invention depicted in FIGS. 2 and 3A-4B are designated by the same reference numerals to which 400 has been added, sometimes without being described in detail since similarities between the corresponding parts in the two embodiments will be readily perceived by the reader.

Figure 13:
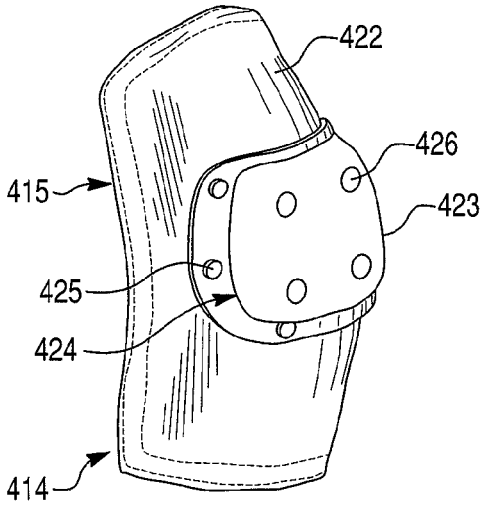
FIG. 13 is a front perspective view of an outer member of a knee pad assembly in accordance with the fifth exemplary embodiment of the present invention.
Figure 14A:
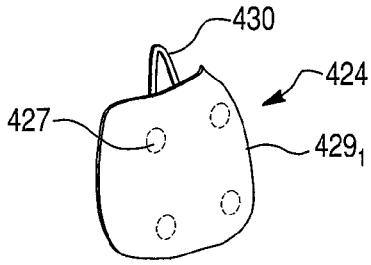
FIG. 14A is a front perspective view of an outer protective pad in accordance with the fifth exemplary embodiment of the present invention.
Figure 14B:
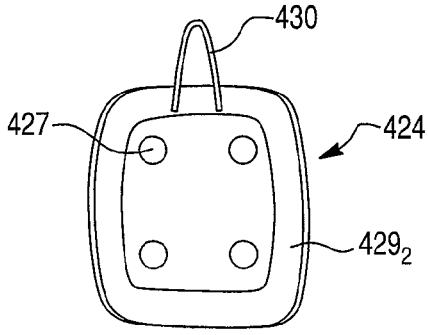
FIG. 14B is a rear perspective view of the outer protective pad in accordance with the fifth exemplary embodiment of the present invention.

The outer member 414 includes a base portion 415 and an outer protective pad 424. The outer member 314 further comprises a securing device provided for releasably attaching the outer protective pad 424 to the base portion 415. Specifically, the securing device includes at least one outer magnetically attractive element 426 attached to a mounting base 423 of the base portion 415, and at least one inner magnetically attractive element 427 attached to the outer protective pad 424. Preferably, as illustrated in FIGS. 13 and 14A-14B, the securing device includes a plurality of the outer and inner magnetically attractive elements 426 and 427, respectively. Moreover, the number and location of the outer magnetically attractive elements 426 is complementary to a number and location of the inner magnetically attractive elements 427. It will be appreciated that the outer magnetically attractive elements 426 and the inner magnetically attractive elements 427 are magnetically attractable to each other. In turn, the mounting base 423 is attached to a base layer 422 of the base portion 415 with rivets 425.

Figure 15:
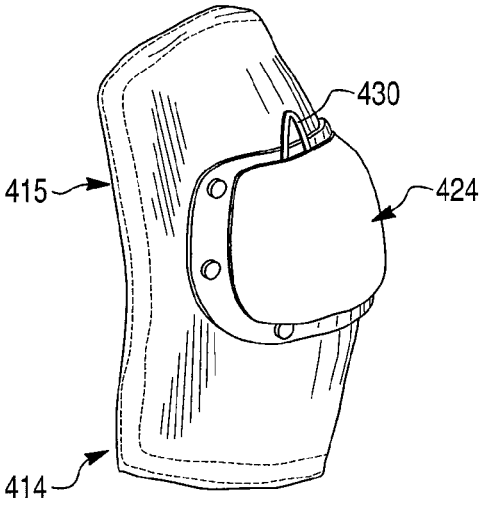
FIG. 15 is another front perspective view of the outer member of the knee pad assembly in accordance with the fifth exemplary embodiment of the present invention.

The outer protective pad 424, illustrated in detail in FIGS. 14A and 14B, includes a front layer $\mathbf{429}_1$ and a base layer $\mathbf{429}_2$ attached to each other in any appropriate manner known in the art. The inner magnetically attractive elements 427, shown in phantom lines in FIG. 14A, are disposed between the front and base layers $\mathbf{429}_1$ and $\mathbf{429}_2$, respectively, of the outer protective pad 424. Further according to the fifth exemplary embodiment of the present invention, at least one of the outer magnetically attractive elements 426 and the inner magnetically attractive elements 427 are in the form of a magnet. Preferably, both the outer magnetically attractive elements 426 and the inner magnetically attractive elements 427 are in the form of magnet, such as permanent magnets. Alternatively, only the outer magnetically attractive elements 426 or the inner magnetically attractive elements 427 are in the form of magnets. FIG. 15 shows the complete assembly of the outer member 414 with the outer protective pad 424 as installed. A pull ring 430 attached to the outer protective pad 424 is provided to disengage the outer protective pad 424 from the base portion 415 of the outer member 314. It would be appreciated that the outer protective pad of the present invention can be manufactured from a range of soft to hard materials and one skilled in the art could easily change outer protective pads to accommodate the type of work and/or flooring without taking the entire knee pad assembly off from the user's leg.

Therefore, the protective pad assembly in accordance with the present invention makes the wearing of protective pad assembly more comfortable and eliminates the risk of blood clots and nerve damage due to the strangulation effect of straps tightly pulled around user's limb.

While the exemplary embodiments of the present invention are described with the reference to the knee pad assembly, it will be appreciated that the present invention is equally applicable to other variations and alternative embodiments of the present invention, such as an elbow pad assembly for releasably attaching to a garment, such as shirt or jacket (not shown). The materials used in construction of the protective pad assembly according to the present invention may include a variety of compositions consistent with the function of the invention.

The description of the preferred embodiments of the present invention has been presented for the purpose of illustration in accordance with the provisions of the Patent Statutes. It is not intended to be exhaustive or to limit the invention to the precise forms disclosed. Multiple variations and alternative embodiments are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. This application is therefore intended to cover any variations, uses, or adaptations of the invention using its general principles. Further, this application is intended to cover such departures from the present disclosure as come within known or customary practice in the art to which this invention pertains. Thus, changes can be made in the above-described invention without departing from the intent and scope thereof. It is also intended that the scope of the present invention be defined by the claims appended thereto.

What is claimed is:

1. A protective pad assembly for releasably attaching to a garment worn by a user of said protective pad assembly for positioning substantially over one of an elbow and a knee of said user, said protective pad assembly comprising:

a flexible inner member provided for engaging said one of said elbow and said knee of said user, said flexible inner member provided to be disposed inside said garment and substantially aligned with said one of said elbow and said knee of said user;

a flexible outer member for protecting said one of said elbow and said knee of said user, said outer member provided to be disposed outside said garment in alignment substantially with said flexible inner member; and a securing device including an inner magnetically attractive element attached to said inner member and an outer magnetically attractive element attached to said outer member, said outer magnetically attractive element and said inner magnetically attractive element being magnetically attractable to each other;

each of said inner and outer flexible members being made of an impact absorbing material;

one of said inner magnetically attractive element and said outer magnetically attractive element being a magnet for magnetically attracting said inner and outer flexible members together;

said securing device provided for releasably attaching said outer member to said inner member solely by the magnetic attraction force between said outer magnetically attractive element and said inner magnetically attractive element.

2. The protective pad assembly as defined in claim 1, wherein the other one of said inner magnetically attractive element and said outer magnetically attractive element is also a magnet.

3. The protective pad assembly as defined in claim 1, wherein the other one of said inner magnetically attractive element and said outer magnetically attractive element is made of a ferromagnetic material and is not a magnet.

4. The protective pad assembly as defined in claim 1, wherein said securing device includes a plurality of inner magnetically attractive elements attached to said inner member and a plurality of outer magnetically attractive elements attached to said outer member, said outer magnetically attractive elements and said inner magnetically attractive elements are magnetically attractable to each other; and wherein one of said inner magnetically attractive elements and said outer magnetically attractive elements are magnets.

5. The protective pad assembly as defined in claim 4, wherein a number and location of said inner magnetically attractive elements is complementary to a number and location of said outer magnetically attractive elements.

6. The protective pad assembly as defined in claim 1, wherein each of said inner and outer magnetically attractive elements is in the form of a sheet of magnetically attractive material.

7. The protective pad assembly as defined in claim 6, wherein said sheet of said inner magnetically attractive element is flexible.

8. The protective pad assembly as defined in claim 7, wherein said flexible sheet of said inner magnetically attractive element is made of a ferromagnetic material and is not a magnet.

9. The protective pad assembly as defined in claim 1, wherein said outer magnetically attractive element is in the form of an electromagnet.

10. The protective pad assembly as defined in claim 1, wherein said flexible inner member includes a front layer and a base layer attached to each other.

11. The protective pad assembly as defined in claim 10, wherein said inner magnetically attractive element is disposed between said front and base layers.

12. The protective pad assembly as defined in claim 10, wherein said inner magnetically attractive element is affixed to an outer surface of said front layer of said inner member.

13. The protective pad assembly as defined in claim 1, wherein said outer member includes a front layer and a base layer attached to each other.

14. The protective pad assembly as defined in claim 13, wherein said outer magnetically attractive element is disposed between said front and base layers.

15. The protective pad assembly as defined in claim 13, wherein said inner magnetically attractive element is affixed to an outer surface of said front layer of said inner member.

16. The protective pad assembly as defined in claim 1, further comprising an outer protective pad attached to said outer member for protecting said one of said elbow and said knee of said user; said outer protective pad is made of one of hard, semi-hard material and soft cushioning material.

17. The protective pad assembly as defined in claim 16, wherein said outer protective pad is releasably attachable to said outer member by magnetic attraction.

18. The protective pad assembly as defined in claim 17, wherein said outer protective pad includes a magnetically attractive element.

19. The protective pad assembly as defined in claim 17, wherein said outer member includes a mounting base receiving said outer protective pad.

20. The protective pad assembly as defined in claim 19, wherein said outer member includes a magnetically attractive element affixed to said mounting base thereof.

21. The protective pad assembly as defined in claim 1, wherein said flexible inner member includes a soft cushioning lining to protect said outwardly flexing joint of said user.

22. A protective pad assembly for releasably attaching to a garment worn by a user of said protective pad assembly for positioning substantially over one of an elbow and a knee of said user, said protective pad assembly comprising:

a flexible inner member provided for engaging said one of said elbow and said knee of said user, said flexible inner member provided to be disposed inside said garment and substantially aligned with said one of said elbow and said knee of said user;

a flexible outer member for protecting said one of said elbow and said knee of said user, said outer member provided to be disposed outside said garment in alignment substantially with said flexible inner member;

an outer protective pad attached to said outer member for protecting said one of said elbow and said knee of said user, said outer protective pad being made of one of hard and semi-hard material; and a securing device including an inner magnetically attractive element attached to said inner member and an outer magnetically attractive element attached to said outer member, said outer magnetically attractive element and said inner magnetically attractive element being magnetically attractable to each other;

each of said inner and outer flexible members being made of an impact absorbing material;

one of said inner magnetically attractive element and said outer magnetically attractive element being a magnet for magnetically attracting said inner and outer flexible members together;

said securing device provided for releasably attaching said outer member to said inner member solely by the magnetic attraction force between said outer magnetically attractive element and said inner magnetically attractive element.

* * * * *